US007416827B2

(12) United States Patent
Farrugia et al.

(10) Patent No.: US 7,416,827 B2
(45) Date of Patent: Aug. 26, 2008

(54) ULTRA LOW MELT TONERS HAVING SURFACE CROSSLINKING

(75) Inventors: Valerie M. Farrugia, Oakville (CA); Guerino G. Sacripante, Oakville (CA); Michael S. Hawkins, Cambridge (CA); Ke Zhou, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 491 days.

(21) Appl. No.: 11/169,757

(22) Filed: Jun. 30, 2005

(65) Prior Publication Data

US 2007/0003856 A1 Jan. 4, 2007

(51) Int. Cl.
*G03G 9/00* (2006.01)

(52) U.S. Cl. ..... 430/110.2; 430/109.1; 430/137.11; 430/137.14

(58) Field of Classification Search ..... 430/110.2, 430/109.1, 137.11, 137.14
See application file for complete search history.

(56) References Cited

U.S. PATENT DOCUMENTS 3,847,604 A 11/1974 Hagenbach et al.
4,254,207 A 3/1981 Landoll et al.
4,935,326 A 6/1990 Creatura et al.
4,937,166 A 6/1990 Creatura et al.
4,952,477 A 8/1990 Fuller et al.
4,990,424 A 2/1991 Van Dusen et al.
5,057,392 A 10/1991 McCabe et al.
5,147,747 A 9/1992 Wilson et al.
5,166,026 A 11/1992 Fuller et al.
5,593,807 A 1/1997 Sacripante et al.
5,916,725 A 6/1999 Patel et al.
6,413,691 B2 7/2002 Daimon et al.
2003/0027073 A1 * 2/2003 Serizawa et al. ..... 430/124

OTHER PUBLICATIONS

U.S. Appl. No. 11/037,214, filed Jan. 19, 2005, Patel et al.
U.S. Appl. No. 11/089,149, filed Mar. 25, 2005, Sacripante et al.

* cited by examiner

*Primary Examiner*—Mark A Chapman
(74) *Attorney, Agent, or Firm*—Oliff & Berridge, PLC

(57) ABSTRACT

Ultra low melt toner compositions with improved non-additive heat cohesion are disclosed. These toner compositions include toner particles comprising amorphous resins containing at least one unsaturated moiety, and when the toner particles are surface treated with a peroxy compound and optionally with a peroxy promoter compound, the surface of the toner particles is cross-linked to form a thin, robust shell. Processes for preparing the toner compositions are also described.

20 Claims, No Drawings

ULTRA LOW MELT TONERS HAVING SURFACE CROSSLINKING

BACKGROUND

The present disclosure relates generally to toner compositions comprising a binder that comprises an amorphous polymer resin containing an unsaturated moiety, in which the surface is cross-linked to form a thin robust shell when surface treated with a peroxide. Additionally, exemplary embodiments relate to processes for forming such toner compositions. These toner compositions are particularly useful in xerographic or electrostatographic printing processes, and are described with particular reference thereto. However, exemplary embodiments are also useful in other applications.

Xerographic toners of a resin, a pigment, and a charge control agent are known. Toners useful for xerographic applications should exhibit certain performances related to storage stability, and particle size integrity; that is, the toner particles should remain intact and not agglomerate until fused on paper. The toner compositions also should not substantially agglomerate at temperatures below about 50° C. to about 55° C., because environmental conditions vary. The toner compositions should also display acceptable triboelectric properties that vary with the type of carrier or developer composition.

Another desirable property for xerographic toner compositions to possess is fusing property on paper. There is pressure to reduce the fusing or fixing temperatures of toners onto paper, for example, to fixing temperatures of from about 90° to about 120° C., to lower power consumption and to allow extended fuser system lifetimes. Non-contact fusers, which heat toner images on paper by radiant heat, usually are not in contact with the paper and the toner image. Contact fusers, on the other hand, are in contact with the paper and the toner image, and the toner compositions used with contact fusers should not substantially transfer onto the fuser roller.

Toner fixing performance can be characterized as a function of temperature. The maximum temperature at which the toner does-not adhere to the fuser roll is called the hot offset temperature (HOT). When the fuser temperature exceeds the toner's HOT, some of the molten toner adheres to the fuser roll during fixing and is transferred to subsequent substrates containing developed images. This transfer may result in blurred images. This undesirable phenomenon is called hot offset or cold offset depending on whether the temperature is below the fixing temperature of the paper (cold offset), or above the fixing temperature of the toner (hot offset).

The minimum fixing temperature (MFT) of the toner, which is the minimum temperature at which acceptable adhesion of the toner to the support medium occurs, should be as high as possible, but is always less than the toner composition's HOT. The MFT is determined, for example, by a crease test. The difference between MFT and HOT is called the fusing latitude of the toner, i.e., the temperature difference between the fixing temperature and the temperature at which the toner offsets onto the fuser.

Additionally, small-sized toner particles, such as those having average particle sizes of from about 3 to about 12 microns, such as from about 5 to about 7 microns, are desired, especially for use in high resolution xerographic engines. Small-sized toner particles can be economically prepared by chemical processes, which involve the direct conversion of emulsion-sized particles to toner composites by aggregation and coalescence, or by suspension, micro-suspension or micro-encapsulation processes.

Low temperature fixing toners comprised of semi-crystalline resins are known. For example, U.S. Pat. No. 5,166,026 discloses semi-crystalline copolymer resin toners, with melting points of from about 30° C. to about 100° C., and containing functional groups comprising hydroxy, carboxy, amino, amido, ammonium or halo, and pigment particles. Similarly, U.S. Pat. No. 4,952,477 discloses toner compositions of semi-crystalline polyolefin resin particles, with melting points of from about 50° C. to about 100° C., and containing functional groups comprising hydroxy, carboxy, amino, amido, ammonium or halo, and pigment particles. Although, some of these toners may provide low contact fixing temperatures of about 93.3° C. to about 107.2° C., the resins are derived from components with melting characteristics of about 30° C. to about 50° C., and are not believed to exhibit higher, more desirable melting characteristics, such as about 55° C. to about 60° C. The '026 and '477 patents are incorporated herein by reference in their entirety.

U.S. Pat. No. 4,990,424, the disclosure of which is incorporated herein by reference in its entirety, discloses toners comprised of a blend of resin particles containing styrene polymers or polyesters and components selected from the group consisting of semi-crystalline polyolefin and copolymers thereof with a melting point of from about 50° C. to about 100° C. Fusing temperatures of from about 250° F. to about 330° F. are reported.

Crystalline-based toners are disclosed in U.S. Pat. No. 4,254,207, the disclosure of which is incorporated herein by reference in its entirety. Low fixing toners comprised of cross-linked crystalline resin and amorphous polyester resin are illustrated in U.S. Pat. No. 5,147,747 and U.S. Pat. No. 5,057,392, the disclosures of which are incorporated herein by reference in its entirety, in which the toner powder is comprised, for example, of polymer particles of partially carboxylated crystalline polyester and partially carboxylated amorphous polyester that has been cross-linked together at elevated temperature with the aid of an epoxy resin and a cross-linking catalyst.

U.S. Pat. No. 5,916,725, the disclosure of which is incorporated herein by reference in its entirety, describes a process for preparing toner compositions comprising mixing an amine, an emulsion latex containing sulfonated-polyester resin, and a colorant dispersion, heating the resulting mixture, and optionally cooling.

U.S. Pat. No. 5,593,807, the disclosure of which is incorporated herein by reference in its entirety, provides a process for preparing toner compositions comprising (i) preparing an emulsion latex comprised of sodio-sulfonated polyester resin particles of from about 5 to about 500 nanometers in size diameter by heating the resin in water at a temperature of from about 65° C. to about 90° C.; (ii) preparing a pigment dispersion in water by dispersing in water from about 10 to about 25 weight percent of sodio-sulfonated polyester and from about 1 to about 5 weight percent of pigment; (iii) adding the pigment dispersion to the latex mixture with shearing, followed by the addition of an alkali halide in water until aggregation results as indicated, for example, by an increase in the latex viscosity of from about 2 centipoises to about 100 centipoises; (iv) heating the resulting mixture at a temperature of from about 45° C. to about 55° C. to cause further aggregation and enabling coalescence to form toner particles of from about 4 to about 9 microns in volume average diameter and with a geometric distribution of less than about 1.3; and optionally (v) cooling the product mixture to about 25° C. and washing and drying the product. The sulfonated polyesters disclosed in the '807 patent may be selected for use in embodiments.

Conventional low melt toner compositions, such as those described above, generally exhibit a ratio of amorphous resin to crystalline resin of 80 to 20, and meet the crease, gloss, latitude, and charging performance requirements of high-speed production printing. These toners also meet heat-cohesion requirements when less than 10% additives are present.

However, there remains a need for ultra-low melt toners with improved heat cohesion for non-additive heat-cohesion requirements and that still provide excellent image properties. There is thus also a need to provide a process for preparing such low-melt emulsion-aggregation toners that allows for controlled particle growth and controlled morphology or shape, and provides high yields.

SUMMARY

Toner compositions comprising surface cross-linked, ultra-low melt toner particles that include a resin containing at least one unsaturated moiety that cross-links upon surface treatment with a peroxide to form a thin robust shell are provided. Methods of preparing such toner compositions are also provided.

In embodiments, toners comprised substantially of polyester, a colorant and optionally a wax are provided.

Separately provided are developer compositions containing surface cross-linked, ultra-low melt toner particles and a carrier.

Image forming apparatuses are separately provided, in which developer compositions contain surface cross-linked, ultra-low melt toner particles.

In embodiments, processes for preparing surface cross-linked, ultra-low melt toner particles are provided. For example, processes of forming ultra-low melt toner particles that include an amorphous resin containing at least one unsaturated moiety that cross-links upon surface treatment with a peroxide to form a thin robust shell are described.

Separately, processes for preparing toner particles that comprise providing one or more aqueous dispersions, the aqueous dispersions comprising particles including particles of one or more resins; homogenizing the aqueous dispersions; aggregating particles to form aggregated particles; coalescing the aggregated particles to form fused particles; optionally removing the fused particles from the aqueous dispersion; and treating the surface of the fused particles with a peroxide to provide surface cross-linked particles; in which the surface cross-linked particles have an average particle diameter of from about 1 to about 15 microns, with a particle geometric size distribution of less than about 1.25, are provided.

These and other features and advantages of various exemplary embodiments of materials, devices, systems and/or methods are described in or are apparent from, the following detailed description.

DETAILED DESCRIPTION OF EMBODIMENTS

In embodiments, the toner compositions comprise toner particles including a binder that comprises at least one amorphous resin that contains at least one unsaturated moiety. When the toner particles are treated with a peroxy compound and optionally with a peroxy promoter compound, surfaces of the toner particles become cross-linked. This provides a thin, robust shell on the toner particles.

Suitable amorphous resins that may be used in embodiments include linear amorphous resins. For example, the amorphous resin may be selected from amorphous polyester resins and amorphous sulfonated polyester resins. In embodiments, branched amorphous sulfonated polyesters may be substituted for unsaturated linear sulfonated-polyesters.

Suitable linear unsaturated sulfonated polyester resins that may be used in embodiments include those representable by the following structure, in which j, k and m represent the number of repeating units of each portion of the structure.

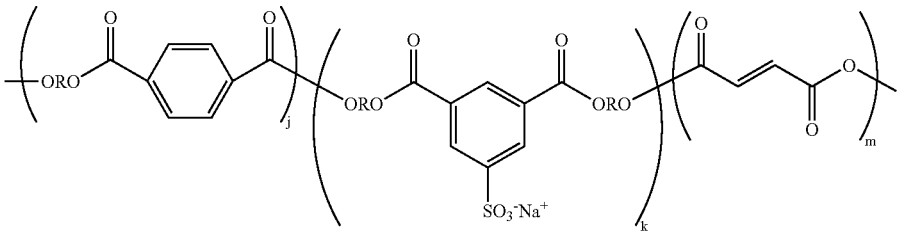

The linear and branched amorphous polyester resins, in embodiments, possess, for example, a number-average molecular weight (Mn), as measured by GPC, of from about 10,000 to about 500,000 and, in embodiments, from about 5,000 to about 250,000; a weight-average molecular weight (Mw) of, for example, from about 20,000 to about 600,000, and, in embodiments, from about 7,000 to about 300,000, as determined by GPC using polystyrene standards; and a molecular-weight distribution (Mw/Mn) of, for example, from about 1.1 to about 6, and, in embodiments, from about 1.2 to about 4.

The linear amorphous polyester resins may be prepared by the polycondensation of an organic diol and a diacid or diester, at least one of which is sulfonated or a sulfonated difunctional monomer being included in the reaction, and a polycondensation catalyst. For the branched amorphous sulfonated polyester resin, the same materials may be used, with the further inclusion of a branching agent such as a multivalent polyacid or polyol.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. In embodiments, organic diacid or diester may be used in amounts ranging from about 45 to about 52 mole % of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexane-dimethanol, xylenedimethanol, cyclohexanediol, diethylene glycol, bis (2-hydroxyethyl) oxide, dipropylene glycol, dibutylene, and mixtures thereof. The amount of organic diol selected can vary, and more specifically, is, for example, from about 45 to about 52 mole % of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxy-benzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxy-ethyl)-2-aminoethane sulfonate, 2-sulfo-3,3-dimethylpent- anediol, sulfo-p-hydroxybenzoic acid, mixtures thereto, and the like. Effective difunctional monomer amounts of, for example, from about 0.1 to about 2 weight % of the resin can be selected.

Branching agents that may be used in embodiments include, for example, multivalent polyacids, such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid; acid anhydrides of multivalent polyacids; and lower alkyl esters of multivalent polyacids; multivalent polyols, such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected may be, for example, from about 0.1 to about 5 mole % of the resin.

Polycondensation catalysts that may be used for amorphous polyesters include, for example, tetraalkyl titanates, dialkyltin oxide such as dibutyltin oxide; tetraalkyltins, such as dibutyltin dilaurate; dialkyltin oxide hydroxides, such as butyltin oxide hydroxide; aluminum alkoxides; alkyl zinc; dialkyl zinc; zinc oxide; stannous oxide; and mixtures thereof. Such polycondensation catalysts may be selected in amounts of, for example, from about 0.01 to about 5 mole % based on the starting diacid or diester used to generate the polyester resin.

In embodiments, the toner composition includes a binder that also comprises a crystalline resin, such as a crystalline sulfonated polyester. In particular embodiments, the binder may comprise from about 20 to about 60 weight %, or about 20 to about 45 weight % of crystalline sulfonated polyester, and about 40 to about 80 weight %, or about 55 to about 80 weight % of linear amorphous sulfonated polyester. In embodiments, the crystalline, linear amorphous and branched amorphous sulfonated polyester materials of the binder may each be the same or different.

Further, portions of the linear amorphous polyester may be replaced in the binder with branched amorphous sulfonated polyester. Branched herein refers to a polymer with chains linked to form a cross-linked network. For example, up to 80 weight % of the linear amorphous sulfonated polyester may be replaced with a branched amorphous sulfonated polyester, if desired. The inclusion of branched polyester portions may be used to impart elasticity to the binder, which improves the toner offset properties while not substantially affecting the minimum fixing temperature (MFT).

Crystalline sulfonated polyester, as used herein, refers to a sulfonated polyester polymer having a three dimensional order. By crystalline is meant that the sulfonated polyester has some degree of crystallinity, and thus crystalline is intended to encompass both semicrystalline and fully crystalline sulfonated polyester materials. The polyester is considered crystalline when it is comprised of crystals with a regular arrangement of its atoms in a space lattice.

In embodiments, the crystalline, linear amorphous and branched amorphous sulfonated polyester resins are each alkali sulfonated polyester resins. The alkali metal in the respective sulfonated polyester resins may independently be lithium, sodium, or potassium, for example.

In general, the sulfonated polyesters may have the following general structure, or random copolymers thereof in which the n and p segments are separated.

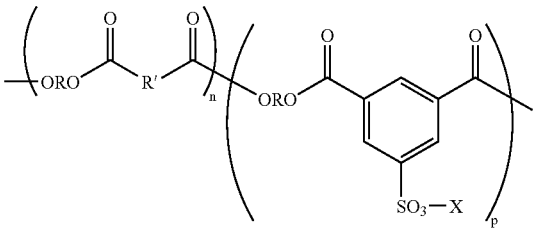

wherein R is an alkylene of, for example, from 2 to about 25 carbon atoms such as ethylene, propylene, butylene, oxyalkylene diethyleneoxide, and the like; R' is an arylene of, for example, from about 6 to about 36 carbon atoms, such as a benzylene, bisphenylene, bis(alkyloxy) bisphenolene, and the like; and p and n represent the number of randomly repeating segments, such as for example from about 10 to about 100,000.

Examples of amorphous alkali sulfonated polyester based resins include, but are not limited to, copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly (propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion. Examples of crystalline alkali sulfonated polyester based resins alkali copoly(5-sulfoisophthaloyl)-co-poly(ethylene-adipate), alkali copoly(5-sulfoisophthaloyl)-copoly(propylene-adipate), alkali copoly(5-sulfoisophthaloyl)-copoly(butylene-adipate), alkali copoly (5-sulfo-isophthaloyl)-copoly(pentylene-adipate), and alkali copoly(5-sulfo-iosphthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-co-poly (butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly (5-sulfoisophthaloyl)-copoly(ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly (propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly (pentylene-adipate), alkali copoly(5-sulfo-isophthaloyl) copoly(hexylene-adipate), poly(octylene-adipate), and wherein the alkali is a metal like sodium, lithium or potassium. In embodiments, the alkali metal is lithium.

The crystalline resin can possess various melting points of, for example, from about 30° C. to about 120° C., and, in embodiments, from about 50° C. to about 90° C. The crystalline resin may have, for example, a number-average molecular weight (Mn), as measured by gel permeation chromatography (GPC) of, for example, from about 1,000 to about 50,000, and, in embodiments, from about 2,000 to about 25,000. The weight-average molecular weight (Mw) of the resin may be, for example, from about 2,000 to about 100,000, and, in embodiments, from about 3,000 to about 80,000, as determined by GPC using polystyrene standards. The molecular weight distribution (Mw/Mn) of the crystalline resin is, for example, from about 2 to about 6, and, in embodiments, from about 2 to about 4.

The crystalline resins can be prepared by the polycondensation process of reacting suitable organic diols with suitable organic diacids or diesters, at least one of which is sulfonated or at least one further difunctional sulfonated monomer being included in the reaction, in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole % of the resin. When organic diesters are used in place of organic diacids, an alcohol byproduct should be generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole % of the resin, and the alkali sulfo-aliphatic diol can be selected in an amount of from about 1 to about 10 mole % of the resin.

Examples of organic diacids or diesters selected for preparing of the crystalline resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride, thereof; and alkali sulfo-organic diacids, such as the sodio, lithio or potassium salts of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbo-methoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole % of the resin, and the alkali sulfoaliphatic diacid can be selected in an amount of from about 1 to about 10 mole % of the resin.

The branching agents and polycondensation catalysts that may be used in the preparation of amorphous polyesters may likewise be used in the preparation of crystalline polyesters of embodiments. Such branching agents may be used in amounts of, for example, from about 0.1 to about 5 mole % of the resin, and such polycondensation catalysts may be used in amounts of, for example, from about 0.01 to about 5 mole % based on the starting diacid or diester used to generate the polyester resin.

The toner particles may be prepared by a variety of known methods. Although embodiments relating to toner particle production are described below with respect to emulsion-aggregation processes, any suitable method of preparing toner particles may be used, including chemical processes, such as the suspension and encapsulation processes disclosed in U.S. Pat. Nos. 5,290,654 and 5,302,486, the disclosures of which are incorporated herein in their entirety. In embodiments, toner compositions and toner particles are prepared by well-known aggregation and coalescence processes in which small-size resin particles are aggregated to the appropriate toner particle size and then coalesced to achieve the final toner-particle shape and morphology.

In embodiments, toner compositions may be prepared by any of the known emulsion-aggregation processes, such as a process that includes aggregating a mixture of an optional colorant, an optional wax and any other desired or required additives, and emulsions comprising the binder resins, and then coalescing the aggregate mixture. A pre-toner mixture is prepared by adding the colorant, and optionally a wax or other materials, to the emulsion, which may be a mixture of two or more emulsions containing the toner binder resin. In embodiments, the pH of the pre-toner mixture is adjusted to between about 4 to about 5. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature ($T_g$) of the emulsion resin. In some embodiments, the aggregating agent may be added in an amount of about 0.05 to about 3.0 pph and from about 1.0 to about 10 pph with respect to the weight of toner. The aggregating agent may be added to the pre-toner mixture over a period of from about 0 to about 60 minutes. Aggregation may be accomplished with or without maintaining homogenization. Aggregation is accomplished at temperatures that are preferably greater then 60° C.

In embodiments, although either a multivalent salt, such as polyaluminum chloride, or a divalent salt, such as zinc acetate, may be used, and the toner formulations may be identical for both aggregating agents, the process of preparing the toner particles is different. A divalent cation material is used in embodiments in which the binder includes both linear amorphous and crystalline polyesters. In the case of the multivalent salt, anion and nonionic surfactants can be added to the latex mixture to stabilize the particle and reduce the shocking when a multivalent aggregating agent like PAC is added. PAC is also required to be added at room temperature (cold addition) to initiate aggregation in the presence of the pigment, since the addition of PAC at elevated temperature is typically not effective. In embodiments in which divalent salts are used as aggregating agents, the agent may be added at elevated temperature, for example about 50 to 60° C. (hot addition) as opposed to cold addition. The primarily reason for this is that zinc acetate dissociates itself into the aqueous phase and the particle (pKa of zinc acetate is about 4.6). The dissociation is temperature dependent as well as pH dependent. When zinc acetate is added at elevated temperature, the temperature factor is minimized or eliminated. The amount of zinc acetate added can controlled to control the particle size, while in the case of cold addition of zinc acetate, neither of these parameters can be controlled. In addition, because the linear amorphous sulfonated polyester resin emulsion is prepared by dissolving or dissipating the resin at temperatures of about 60 to 70° C., the emulsion may be heated to elevated an temperature in order to prevent to the dissipation or dissolution of the polyester resin.

Thus, the process calls for blending the crystalline polyester resin and the linear and/or branched amorphous polyester resin emulsions, together in the presence of a pigment and optionally a wax or other additives, all comprising submicron particles, heating the blend from room temperature to about 60° C., followed by addition of addition of zinc acetate solution. The temperature may be slowly raised to 65° C. and held there for about 6 hours to provide 9 micron particles the have a shape factor of, for example, about 115 to about 130 as measured on the FPIA SYSMEX analyzer.

When a multivalent ion like PAC is used as the aggregating agent, it must be added cold as discussed above. Thus, the process steps are different than with zinc acetate, and calls for the addition of surfactants to the latex blend, followed by the addition of the pigment and optional additives. The surfactant stabilizes the particles by either electrostatic or steric forces or both, to prevent massive flocculation, when the aggregating agent is added. The pH of the blend containing the blend of toners, pigment, optional additives (wax), etc. is adjusted from about 5.6 to about 3.0 with 0.1 M nitric acid, followed by the addition of PAC, while being polytroned at speeds of about 5000 rpm. The temperature of the mixture is raised from room temperature to 55° C., and slowly in stages to about 65° C. in order to coalesce the particles. No pH adjustment is required to stabilize the particle size in either of the two aggregating agent processes.

Following aggregation, the aggregates are coalesced. Coalescence may be accomplished by heating the aggregate mixture to a temperature that is about 5 to about 20° C. above the $T_g$ of the emulsion resin. Generally, the aggregated mixture is heated to a temperature of about 50 to about 80° C. In embodiments, the mixture may also be stirred at from about 200 to about 750 revolutions per minute to coalesce the particles. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

After coalescence, the mixture may be cooled to room temperature. After cooling, the mixture of toner particles of some embodiments may be washed with water and then dried. Drying may be accomplished by any suitable method for drying including freeze drying. Freeze drying is typically accomplished at temperatures of about −80° C. for a period of about 72 hours.

Upon aggregation and coalescence, the toner particles of embodiments have an average particle size of from about 1 to about 15 microns, in further embodiments of from about 4 to about 15 microns, and, in particular embodiments, of from about 6 to about 11 microns. The geometric size distribution (GSD) of the toner particles of embodiments may be in a range of from about 1.20 to about 1.35, and in particular embodiments of less than about 1.25.

In embodiments, the process may include the use of surfactants, emulsifiers, and other additives such as those discussed above. Likewise, various modifications of the above process will be apparent and are encompassed herein.

In order to form a cross-linked shell on the toner particles, the fused particles may be treated with one or more peroxy compounds. Optionally, one or more peroxy promoter compounds may also be included. Treating the fused particles with peroxy compounds and optional peroxy promoter compounds results in a cross-linking reaction on the surface of the toner particles. The surface treatment of toner particles in embodiments may be performed in situ. In alterative embodiments, the toner particles may be washed and dried prior to surface treatment.

As the peroxy compound of embodiments, any suitable peroxy compound may be used. In particular embodiments, suitable peroxy compounds include but are not limited to, for example, hydrogen peroxide; diacylperoxides, such as decanoyl peroxide, diacetyl peroxide, dibenzoyl peroxide, di-p-chlorobenzoyl peroxide, dilauroyl peroxide; peroxyesters, such as tert-butylperoxy-2-ethylhexanoate and tert-butylperoxy benzoate, tert-butyl peroxyacetate, dicyclohexyl peroxy dicarbonate; hydroperoxides, such as tert-butyl hydroperoxide, cyclohexanone hydroperoxide, methylethyl ketone hydroperoxide and cumene hydroperoxide; perketals, such as tert-butyl peroxyneodecanoate, 2,5-dimethyl-2,5-di (2-ethylhexanoyl peroxy) hexane, 1,1-di(tert-butylperoxy)-3,3,5-trimethylcyclohexane and 1,1-di(tert-butylperoxy)-cyclohexane; alkyl peroxides, such as dicumyl peroxide, bis-(tert-butyl peroxybutane) and tert-butylcumyl peroxide; ketone peroxides, such as methyl ethyl ketone peroxide, methyl isobutyl ketone peroxide, acetyl acetone peroxide, 2,4-pentanedione peroxide, azoisobutyrodinitrile and cyclohexanone peroxide; and the like; and mixtures thereof.

As the peroxy promoter compound of embodiments, any suitable peroxy promoter compound may be used. In particular embodiments, use may be made, for example, of metal salts, such as cobalt octoate; and mixtures thereof. In embodiments, the peroxy promoter compounds may be heavy metal salts of carboxylic acids, such as vanadium, iron, manganese naphthalates and octoates, and, in particular embodiments, cobalt naphthenates and octoates. In addition, organic compounds, such as dialkyl aryl amines, such as dimethyl anilines and diethyl anilines, which may be para-substituted with organic groups such as phenyl, methyl methoxy, hydroxyl or amino groups. Mixtures of two or more peroxy promoter compounds may be used in embodiments. It is, of course, also possible to use mixtures of the above-mentioned accelerators.

The cross-linking of the toner surface can be initiated at temperatures of from about 25° C. to about 50° C. by using a peroxy compound and an optional metal peroxy promoter compound. The cross-linking reaction is a free radical catalyzed copolymerization between the unsaturated polyester resin chain on the toner particle surface and optionally one or more additional unsaturated compounds.

Any suitable compound, including those commonly used in polyester chemistry, may be used as the additional unsaturated compounds. For example, embodiments may include one or more compounds chosen from α-substituted vinyl or β-substituted allyl compounds, such as styrene, methyl methacrylate, acrylonitrile, vinyl chloride; nucleus-chlorinated, nucleus-alkenylated and nucleus-alkylated styrenes, including alkenyl or alkyl groups containing from 1 to 4 carbon atoms, such as vinyl toluene, divinyl benzene, α-methyl styrene, tert-butyl styrene, chloro-styrenes; vinyl esters of carboxylic acids having from 2 to 6 carbon atoms, such as vinyl acetate; vinyl pyrrolidone, vinyl pyrrolide, vinyl pyridine, vinyl naphthalene, vinyl cyclohexane, acrylic acid and methacrylic acid and/or the esters thereof having from 1 to 4 carbon atoms in the alcohol component, the amides and nitriles thereof; maleic acid anhydride, -semi-esters and -diesters having from 1 to 4 carbon atoms in the alcohol component, -semi-amides and -diamides or cyclic imides, such as N-methyl maleic imide or N-cyclohexyl maleic imide; allyl compounds, such as allyl benzene, and allyl esters, such as allyl acetate, allyl acrylate, allyl methacrylate, phthalic acid diallyl ester, diallyl phthalate, isophthalic acid diallyl ester, fumaric acid diallyl ester, allyl carbonates, diallyl carbonates, triallyl phosphate and triallyl cyanurate; and the like, and mixtures thereof.

Free radicals are generated by the decomposition of the peroxy compound by the peroxy promoter compound. This cycle or reaction is repeated until all of the peroxy compound has been decomposed. The cross-linking of the toner surface gives a network-like coating, with covalent cross-linking bonds connecting between polymer chains.

The following reaction scheme illustrates the cross-linking reaction that forms a shell on the toner particles of an exemplary embodiment, in which the amorphous resin including an unsaturated moiety is surface-treated with a peroxy compound, methyl ethyl ketone peroxide, and a peroxy promoter compound, the metal salt cobalt octoate, in the presence of styrene.

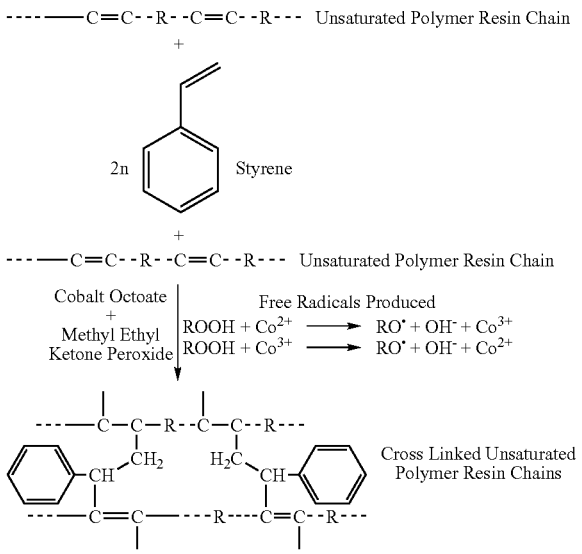

In embodiments, additives may be included in the toner compositions. Appropriate additives for inclusion in embodiments include, for example, colorants; magnetites; flocculates; curing agents; waxes; charge additives; flow-promoting agents; flow-control agents; plasticizers; stabilizers; anti-gassing and degassing agents; leveling agents; surface additives; antioxidants; UV absorbers; light stabilizers; fillers and mixtures thereof. In embodiments, additives may be incorporated into the toner particles during toner particle preparation or after cross-linking, as surface additives. Any suitable method of incorporating additives, either during toner preparation or after surface cross-linking, as surface additives, may be used.

Toner compositions of embodiments may include one or more colorant. Various known suitable colorants include dyes, pigments, mixtures thereof, such as mixtures of dyes, mixtures of pigments and mixtures of dyes and pigments, and the like. Colorants may be included in the toner in an effective amount of, for example, about 1 to about 25 weight % of the toner, and in embodiments, in an amount of about 1 to about 15 weight %.

As examples of suitable colorants, which is not intended to be an exhaustive list, mention may be made of carbon black like REGAL 330®; magnetites, such as MOBAY magnetites MO8029™, MO8060™; COLUMBIAN magnetites; MAPICO BLACKS™ and surface treated magnetites; Pfizer magnetites CB4799™, CB5300™, CB5600™, MCX6369™; Bayer magnetites, BAYFERROX 8600™, 8610™; NORTHERN PIGMENTS magnetites, NP-604™, NP-608™; MAGNOX magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like.

Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as FORON Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants.

Other known colorants can be selected, such as LEVANYL Black A-SF (Miles, Bayer) and SUNSPERSE Carbon Black LHD 9303 (Sun Chemicals), and colored dyes such as NEOPEN Blue (BASF), SUDAN Blue OS (BASF), PV Fast Blue B2G01 (American Hoechst), SUNSPERSE Blue BHD 6000 (Sun Chemicals), IRGALITE Blue BCA (Ciba-Geigy), PALIOGEN Blue 6470 (BASF), SUDAN III (Matheson, Coleman, Bell), SUDAN II (Matheson, Coleman, Bell), SUDAN IV (Matheson, Coleman, Bell), SUDAN Orange G (Aldrich), SUDAN Orange 220 (BASF), PALIOGEN Orange 3040 (BASF), ORTHO Orange OR 2673 (Paul Uhlich), PALIOGEN Yellow 152, 1560 (BASF), LITHOL Fast Yellow 0991K (BASF), PALIOTOL Yellow 1840 (BASF), NEOPEN Yellow (BASF), Permanent Yellow YE 0305 (Paul Uhlich), LUMOGEN Yellow D0790 (BASF), SUNSPERSE Yellow YHD 6001 (Sun Chemicals), SUCO-GELB L1250 (BASF), SUCO-YELLOW D1355 (BASF), FANAL Pink D4830 (BASF), CINQUASIA Magenta (DuPont), LITHOL Scarlet D3700 (BASF), Scarlet for THERMOPLAST NSD PS PA (Ugine Kuhlmann of Canada), LITHOL Rubine Toner (Paul Uhlich), LITHOL Scarlet 4440 (BASF), Royal Brilliant Red RD-8192 (Paul Uhlich), ORACET Pink RF (Ciba-Geigy), PALIOGEN Red 3871K (BASF), PALIOGEN Red 3340 (BASF), and LITHOL Fast Scarlet L4300 (BASF).

Optionally, the toner compositions may also include a wax. When included, the wax may be present in an amount of from about, for example, 1 to about 25 weight %, and, in certain embodiments, from about 5 to about 20 weight %, of the toner. Examples of suitable waxes include, but are not limited to polypropylenes and polyethylenes commercially available from Allied Chemical and Petrolite Corporation (e.g., POLYWAX ™ polyethylene waxes from Baker Petrolite); wax emulsions available from Michaelman, Inc. and the Daniels Products Company, EPOLENE N-15™ commercially available from Eastman Chemical Products, Inc., VISCOL 550-P™; low weight-average molecular-weight polypropylenes available from Sanyo Kasei K. K., CARNUBA Wax and similar materials. Examples of functionalized waxes include, for example, amines; amides, for example AQUA SUPERSLIP 6550™, SUPERSLIP 6530™ available from Micro Powder Inc.; fluorinated waxes, for example POLYFLUO 190™, POLYFLUO 200™, POLYSILK 19™, POLYSILK 14™ available from Micro Powder Inc.; mixed fluorinated amide waxes, for example MICROSPERSION 19™ also available from Micro Powder Inc.; imides; esters; quaternary amines; carboxylic acids or acrylic polymer emulsions, for example JONCRYL 74™, 89™, 130™, 537™, and 538™, all available from SC Johnson Wax; and chlorinated polypropylenes and polyethylenes available from Allied Chemical and Petrolite Corporation and SC Johnson Wax.

The toners of embodiments may also contain other optional additives, as desired or required. For example, the toner may include positive or negative charge enhancing additives, in embodiments in amounts of from about 0.1 to about 10 weight %, or from about 1 to about 3 weight %, of the toner. Examples of these additives include quaternary ammonium compounds inclusive of alkyl pyridinium halides; alkyl pyridinium compounds such as those described in U.S. Pat. No. 4,298,672, the disclosure of which is incorporated herein by reference; organic sulfate and sulfonate compositions such as those described in U.S. Pat. No. 4,338,390, the disclosure of which is incorporated herein by reference; cetyl pyridinium tetrafluoroborates; distearyl dimethyl ammonium methyl sulfate; aluminum salts such as BONTRON E84™ or E88™ (available from Hodogaya Chemical); and the like.

There can also be blended with the toner compositions external additive particles including flow aid additives, which additives may be present on the surface of the toner particles. Examples of these additives include metal oxides like titanium oxide, tin oxide, mixtures thereof, and the like; colloidal silicas, such as AEROSIL®, metal salts and metal salts of fatty acids, including zinc stearate, aluminum oxides, cerium oxides, and mixtures thereof. Each of the external additives may be present in embodiments in amounts of from about 0.1 to about 5 weight %, or from about 0.1 to about 1 weight %, of the toner. Several of the aforementioned additives are illustrated in U.S. Pat. Nos. 3,590,000, 3,800,588, and 6,214,507, the disclosures which are incorporated herein by reference.

The present toners are sufficient for use in an electrostatographic or xerographic process. The present toners generally exhibit a minimum fixing temperature of from about 80 to about 130° C. The present toners exhibit satisfactory properties when used in a xerographic or electrostatographic process. Such properties include a high gloss, which may be in the range of from about 20 to about 60 Garner gloss units (ggu); good charging in high temperature/high- and low-humidity environments; a fusing latitude of 100° C. or more; and substantially no vinyl offset.

The surface cross-linked toner particles according to embodiments display non-additive heat cohesions of less than about 50%, and in specific embodiments, of less than about 20%, such as less than about 10% or less than about 5%.

The toner particles of all embodiments may be included in developer compositions. In embodiments, developer compositions comprise toner particles, such as those described above, mixed with carrier particles to form a two-component developer composition. In some embodiments, the toner concentration in the developer composition may range from about 1 to about 25 weight %, or from about 2 to about 15 weight %, of the total weight of the developer composition.

Illustrative examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like.

The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In applications in which the described toners are used with an image-developing device employing roll fusing, the carrier core may be at least partially coated with a polymethyl methacrylate (PMMA) polymer having a weight-average molecular weight of 300,000 to 350,000, e.g., such as commercially available from Soken. PMMA is an electropositive polymer that will generally impart a negative charge on the toner by contact. The coating has, in embodiments, a coating weight of from, for example, 0.1 to 5.0 weight %, or 0.5 to 2.0 weight % of the carrier. PMMA may optionally be copolymerized with any desired comonomer, so long as the resulting copolymer retains a suitable particle size. Suitable comonomers can include monoalkyl, or dialkyl amines, such as dimethylaminoethyl methacrylates, diethyl-aminoethyl methacrylates, diisopropylaminoethyl methacrylates, tert-butylaminoethyl methacrylates, and the like, and mixtures thereof. The carrier particles may be prepared by mixing the carrier core with from, for example, between about 0.05 to about 10 weight % of polymer, and in embodiments, between about 0.05 and about 3 weight % of polymer, based on the weight of the coated carrier particles, until the polymer coating adheres to the carrier core by mechanical impaction and/or electrostatic attraction. Various effective suitable means can be used to apply the polymer to the surface of the carrier core particles, e.g., cascade-roll mixing, tumbling, milling, shaking, electrostatic powder-cloud spraying, fluidized bed, electrostatic disc processing, and with an electrostatic curtain. The mixture of carrier core particles and polymer is then heated to melt and fuse the polymer to the carrier core particles. The coated carrier particles are then cooled and classified to a desired particle size.

Carrier particles can be mixed with toner particles in any suitable combination in embodiments. In some embodiments, for example, about 1 to about 5 parts by weight of toner particles are mixed with from about 10 to about 300 parts by weight of the carrier particles.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers of the invention via a suitable image development method such as any one of the aforementioned methods, the image is then transferred to an image receiving medium such as paper and the like. In an embodiment of the present invention, it is desired that the toners be used in developing an image in an image-developing device utilizing a fuser roll member. Fuser roll members are contact fusing devices that are well known in the art, in which heat and pressure from the roll are used in order to fuse the toner to the image-receiving medium. Typically, the fuser member may be heated to a temperature just above the fusing temperature of the toner, i.e., to temperatures of from about 80° C. to about 150° C. or more.

Specific examples are described in detail below. These examples are intended to be illustrative, and the materials, conditions, and process parameters set forth in these exemplary embodiments are not limiting. All parts and percentages are by weight unless otherwise indicated.

EXAMPLE

Example 1-Toner Particles

A linear unsaturated resin (below) was prepared from an equimolar reaction of propoxylated bisphenol A and fumaric acid, so that the polymer ends have more acidic groups than the ends of conventional toner binder resins.

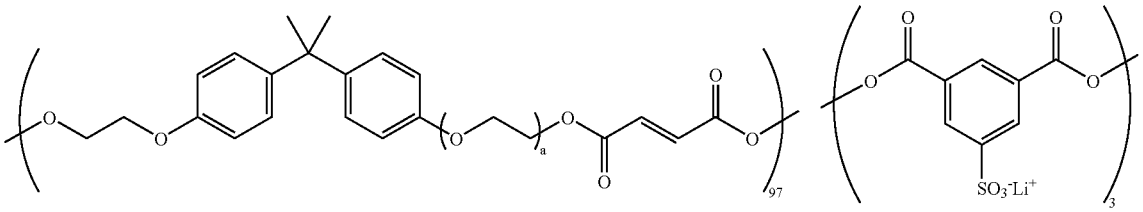

A toner composition was prepared by emulsion-aggregation of 6 weight % of a colorant, Cyan 15:3, 9% of a wax, CARNAUBA Wax and 68 weight % of the sodium sulfonated linear unsaturated resin set forth above, 17% of 1.5% a sodio sulfonated crystalline resin of the following general structure, in which R and R' are alkylene groups of from about 2 to about 20 carbon atoms; r and s are random segments and wherein s is from about 1 to about 6 mole % of resin and r is from about 94 to about 99 mole % of resin.

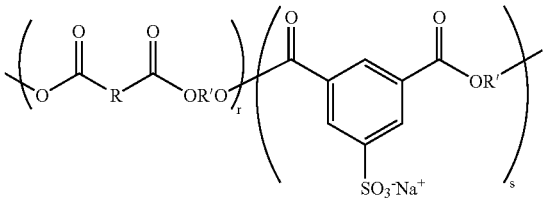

The aggregated particles were coalesced at 68° C. The toner slurry was settled after cooling, the mother liquor was decanted off and the toner particles were reslurried in deionized water.

Example 2-Surface Cross-linked Toner Particles

A portion of the toner particle slurry from Example 1 was heated to 36° C. with stirring at 270 rpm. The reaction was initiated by dispersing 0.54 g of cobalt (II) 2-ethylhexanoate (1.5 weight % relative to toner slurry; supplied as 65 weight % cobalt octoate in low boiling mineral spirits) in the heated toner slurry. Next, 3.04 g of methyl ethyl ketone peroxide (2 weight % relative to toner slurry; supplied as a 23 weight % solution in 2,2,4-trimethyl-1,3-pentanediol diisobutyrate, LUPERSOL DDM-30) was added to the slurry, and mixing was continued. The reaction was left to heat for 26 minutes with agitation before cooling to room temperature, for a total reaction time of over 2 hours with agitation. After cooling to room temperature, the toner was sieved through a 25 micron stainless steel screen (500 mesh) and filtered. The toner particles were reslurried in 1L of deionized water, stirred for 30 minutes and filtered again. This washing procedure was repeated once more, followed by drying the toner composition by freeze drying over 72 hours.

Heat Cohesion Measurements

Five grams of each of the parent toner compositions from Examples 1 and 2 were weighed in a foil plate and conditioned in an environmental chamber at 45° C. and 50% relative humidity for 17 hours. The samples were removed and re-acclimated to ambient temperature for at least 30 minutes. Each re-acclimated sample was then poured over two pre-weighed mesh sieves, which were stacked as follows: 1000 μm on top, 106 μm on bottom. The meshes were vibrated for 90 seconds at an amplitude of 1 mm in a flow tester. The meshes were weighed after vibration and toner heat cohesion was calculated from the total amount of toner remaining on the sieves as a percentage of the starting weight.

The parent heat cohesion measurement for each of Examples 1 and 2 are shown below in Table 1. These results can be compared to the nominal ultra low melt toner which has a cohesion measurement of 77%.

TABLE 1

Toner Cohesion Results

| Sample ID | Heat cohesion |
|---|---|
| Conventional Ultra-Low Melt Toner | 77% |
| Example 1 | 15% |
| Example 2 | 3.6% |

From these results, it can be seen that toner compositions comprising toner particles including a binder that comprises at least one amorphous resin that contains at least one unsaturated moiety, in which the toner particles are surface cross-linked by treatment with a peroxy compound and optionally with a peroxy promoter compound, have improved heat cohesion relative to both conventional ultra-low melt toner compositions and similar toner compositions that do not have surface cross-linking.

It will be appreciated that various of the above-discussed and other features and functions, or alternatives thereof, may be desirably combined into many other different systems or applications. Also, various presently unforeseen or unanticipated alternatives, modifications, variations or improvements may be made by those skilled in the art and are also intended to be encompassed by the following claims.

What is claimed is:

1. Toner particles comprising one or more unsaturated resin, optional colorants and optional waxes, wherein the unsaturated resin is reacted with a peroxy compound and with a peroxy promoter compound to form a cross-linked shell on at least a surface of the toner particles, wherein a heat cohesion of the toner particles is less than 10%.

2. The toner particles according to claim 1, wherein the toner particles are prepared by an emulsion/aggregation process, wherein the emulsion/aggregation process comprises:

providing one or more aqueous dispersions, the aqueous dispersions comprising particles of one or more resin including one or more unsaturated resin;

homogenizing the aqueous dispersions;

aggregating the particles to form aggregated particles;

coalescing the aggregated particles to form toner particles; and optionally removing the toner particles from the aqueous dispersion;

wherein the toner particles have an average particle diameter of from about 1 to about 15 microns, with a particle geometric size distribution of less than about 1.25.

3. The toner particles according to claim 1, wherein the unsaturated resin comprises one or more resin chosen from the group consisting of unsaturated polyester resins, unsaturated sulfonated polyester resins and mixtures thereof.

4. The toner particles according to claim 1, wherein the unsaturated resin comprises one or more resin chosen from the group consisting of amorphous polyester resins and crystalline polyester resins.

5. The toner particles according to claim 1, wherein the unsaturated resin comprises one or more sulfonated polyester resin.

6. The toner particles according to claim 1, wherein the peroxy compound is one or more compound chosen from the group consisting of hydrogen peroxide, diacylperoxides, peroxyesters, hydroperoxides, perketals, alkyl peroxides, ketone peroxides, and mixtures thereof.

7. The toner particles according to claim 1, wherein the peroxy compound is methyl ethyl ketone peroxide.

8. The toner particles according to claim 1, wherein the peroxy promoter compound is one or more compound chosen from the group consisting of metal salts, organic compound, and mixtures thereof.

9. The toner particles according to claim 1, wherein the peroxy promoter compound is one or more compound chosen from the group consisting of cobalt octoates, cobalt naphthalates, vanadium octoates, vanadium naphthalates, iron octoates, iron naphthalates, manganese octoates, manganese naphthalates, dialkyl aryl amines, dimethyl anilines, diethyl anilines and mixtures thereof.

10. A process for preparing toner compositions, the process comprising:

providing toner particles having one or more unsaturated resin on a surface of the toner particles; and cross-linking the unsaturated resin on at least a surface of the toner particles by reacting the unsaturated resin with a peroxy compound and a peroxy promoter compound, wherein a heat cohesion of the toner particles is less than 10%.

11. The process for preparing toner compositions according to claim 10, wherein providing toner particles comprises:

providing one or more aqueous dispersions, the aqueous dispersions comprising particles of one or more resin including one or more unsaturated resin;

homogenizing the aqueous dispersions;

aggregating the particles to form aggregated particles;

coalescing the aggregated particles to form toner particles; and optionally removing the toner particles from the aqueous dispersion;

wherein the toner particles have an average particle diameter of from about 1 to about 15 microns, with a particle geometric size distribution of less than about 1.25.

12. The process for preparing toner compositions according to claim 10, wherein the unsaturated resin comprises one or more resin chosen from the group consisting of unsaturated polyester resins, unsaturated sulfonated polyester resins and mixtures thereof.

13. The process for preparing toner compositions according to claim 10, wherein the unsaturated resin comprises one or more resin chosen from the group consisting of amorphous polyester resins and crystalline polyester resins.

14. The process for preparing toner compositions according to claim 10, wherein the peroxy compound is one or more compound chosen from the group consisting of hydrogen peroxide, diacylperoxides, peroxyesters, hydroperoxides, perketals, alkyl peroxides, ketone peroxides, and mixtures thereof.

15. The process for preparing toner compositions according to claim 10, wherein the peroxy compound is methyl ethyl ketone peroxide.

16. The process for preparing toner compositions according to claim 10, wherein the peroxy promoter compound is one or more compound chosen from the group consisting of metal salts, organic compound, and mixtures thereof.

17. The process for preparing toner compositions according to claim 10, wherein the peroxy promoter compound is one or more compound chosen from the group consisting of cobalt octoates, cobalt naphthalates, vanadium octoates, vanadium naphthalates, iron octoates, iron naphthalates, manganese octoates, manganese naphthalates, dialkyl aryl amines, dimethyl anilines, diethyl anilines and mixtures thereof.

18. The process for preparing toner compositions according to claim 10, wherein the peroxy promoter compound is a metal salt.

19. The process for preparing toner compositions according to claim 18, wherein the metal salt is cobalt octoate.

20. A developer composition comprising carrier particles and a toner composition, wherein the toner composition is prepared by a process comprising:

providing toner particles having unsaturated resin on a surface of the toner particles; and cross-linking the unsaturated resin on at least a surface of the toner particles by reacting the unsaturated resin with a peroxy compound and a peroxy promoter compound, wherein a heat cohesion of the toner particles is less than 10%.

* * * * *